US005287930A

United States Patent [19]

McGill

[11] Patent Number: 5,287,930

[45] Date of Patent: Feb. 22, 1994

[54] VALVE APPARATUS FOR USE IN SAND CONTROL

[75] Inventor: Howard L. McGill, Lufkin, Tex.

[73] Assignee: Dowell Schlumberger Incorporated, Sugar Land, Tex.

[21] Appl. No.: 887,066

[22] Filed: May 22, 1992

[51] Int. Cl.[5] ..... E21B 34/12

[52] U.S. Cl. ..... 166/373; 166/331

[58] Field of Search ..... 166/373, 330, 331, 332

[56] References Cited

U.S. PATENT DOCUMENTS 3,036,810 5/1962 Conrad et al. ..... 166/331

3,842,914 10/1974 Mott ..... 166/377

4,403,659 9/1983 Upchurch ..... 166/331 X

*Primary Examiner*—Terry Lee Melius

*Attorney, Agent, or Firm*—Stephen A. Littlefield

[57] ABSTRACT

In accordance with an illustrative embodiment of the present invention, a circulating valve for use in sand control and related well operations includes a mandrel that can be rotated in a housing after a weight-responsive clutch is released. As the mandrel is rotated to the right, a reverse lead groove system engaged by a pawl causes a valve sleeve element to shuttle down and up between positions closing and opening a flow path between the annulus above a packer and a zone in the well below the packer.

13 Claims, 3 Drawing Sheets

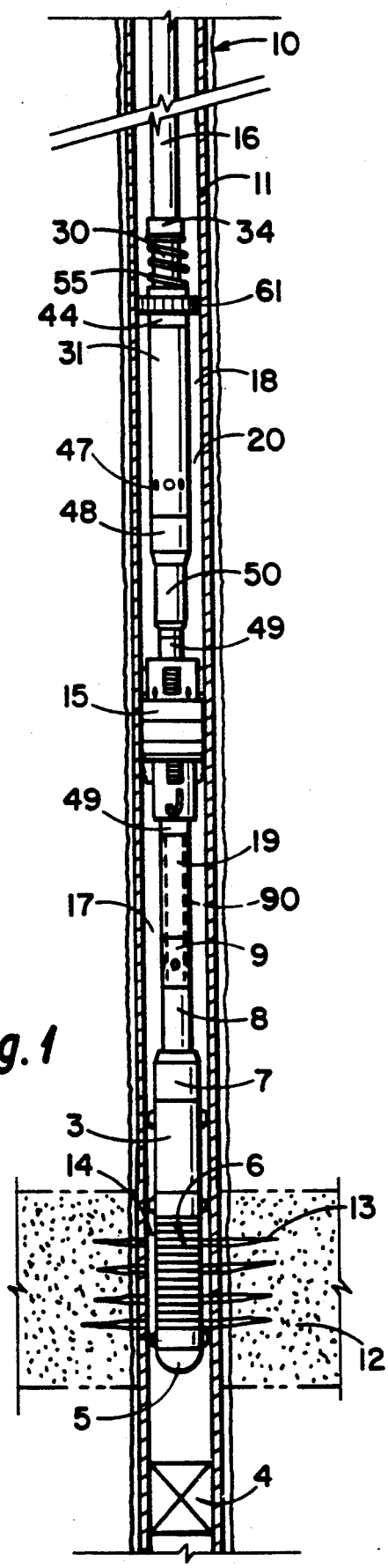
Fig. 1
Fig. 2A
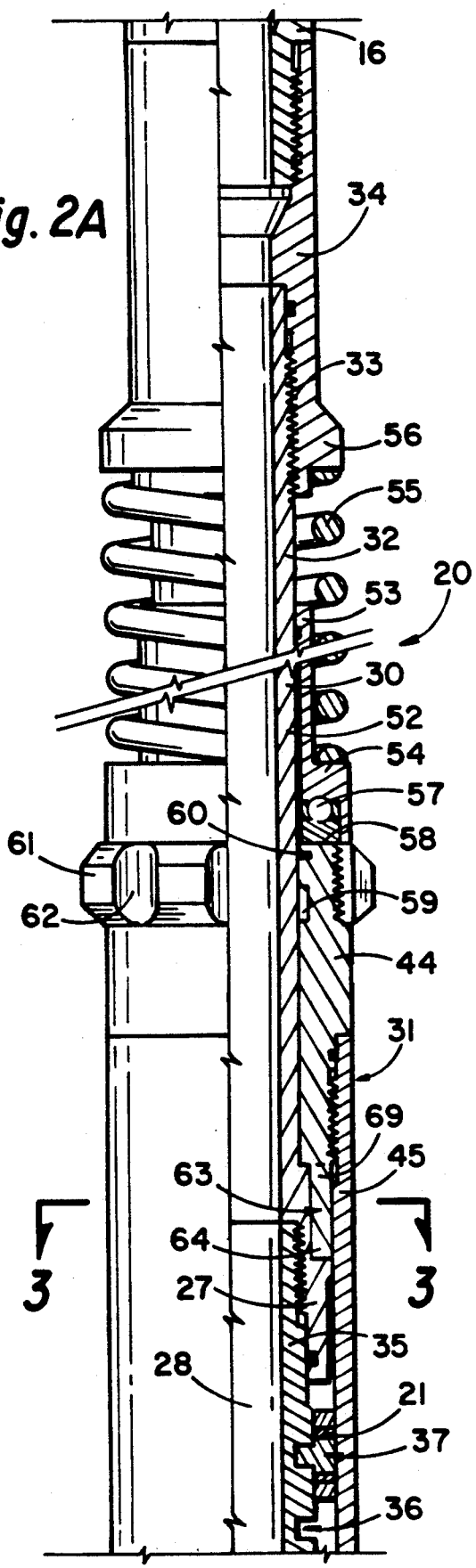

VALVE APPARATUS FOR USE IN SAND CONTROL

FIELD OF THE INVENTION

This invention relates generally to a circulating valve for use primarily in well sand control operations, and particularly to a valve apparatus which can be repeatedly opened and closed to provide selective communication between the casing annulus above a packer and the zone of the well therebelow.

BACKGROUND OF THE INVENTION

To control the entry of sand from a producing formation into a well bore, it has become a fairly common practice to form a gravel pack which lines the well bore in the production interval. Prior to the placement of a gravel pack, it may be desirable to perform certain treatments and squeeze operations which involve high rates of injection. To perform such operations, a special valve is needed which can be repeatedly opened and closed to either communicate the casing annulus above a packer with a zone in the well below it, or isolate the annulus and zone. Such valve apparatus should also be compatible in operation with the requirements for setting a packer which is connected to its lower end. For example a packer may require torque to uncouple a J-slot control so that the slips and packing elements can be set.

A general object of the present invention is to provide a new and improved valve apparatus for controlling fluid communication between the well annulus above a packer and a zone in the well therebelow.

Another object of the present invention is to provide a new and improved valve apparatus of the type described which can be opened and closed an unlimited number of times as necessary to perform a plurality of operations in a well.

Still another object of the present invention is to provide a new and improved valve apparatus of the type described which is manipulated by weight and rotation of the running string to control fluid below the annulus above a packer and a zone below it.

Yet another object of the present invention is to provide a new and improved valve apparatus of the type described which includes a releasable clutch which is engaged to allow the transmission of torque to set a packer and then is disengaged to allow multiple openings and closings of a flow path between the annulus above the packer and the well bore therebelow.

SUMMARY OF THE INVENTION

These and other objects are attained in accordance with the concepts of the present invention through the provision of a flow control valve apparatus having a mandrel that is mounted for rotation and limited downward movement within a housing. In the extended position of the mandrel, a clutch mechanism prevents relative rotation so that torque can be transmitted from the mandrel to the housing in order to set a well packer that is connected to the lower end of the housing. To prevent disengagement of the clutch during setting of the packer, a yieldable means is used to hold the mandrel extended until a predetermined downward force is applied to it by slacking-off a part of the weight of the running string.

A sleeve valve which opens and closes flow ports through the wall of the housing is arranged to be shifted downward and upward by a rotation-responsive actuator mechanism. This mechanism includes an actuator sleeve having a pawl that engages in opposite-hand helical grooves in the mandrel. The actuator sleeve is fixed against rotation relative to the housing, so that rotation of the mandrel and grooves in the right hand direction causes the actuator sleeve and the sleeve valve element to be shifted downward in the housing to a position where the flow ports are closed. Further rotation in the same direction causes the actuator sleeve and valve element to be shifted back upward to a position whose parts are open. Thus the sleeve valve element can be repeatedly closed and opened as many times as may be needed to perform the above-mentioned treating, squeezing and gravel packing operations.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a schematic view of a well having a packer and the valve apparatus of the present invention disposed therein;

FIGS. 2A–2C are longitudinal views of the valve apparatus of FIG. 1, with the left side of each view being in elevation and the right side in section;

DETAILED DESCRIPTION OF A PREFERRED EMBODIMENT

Figure 2B:
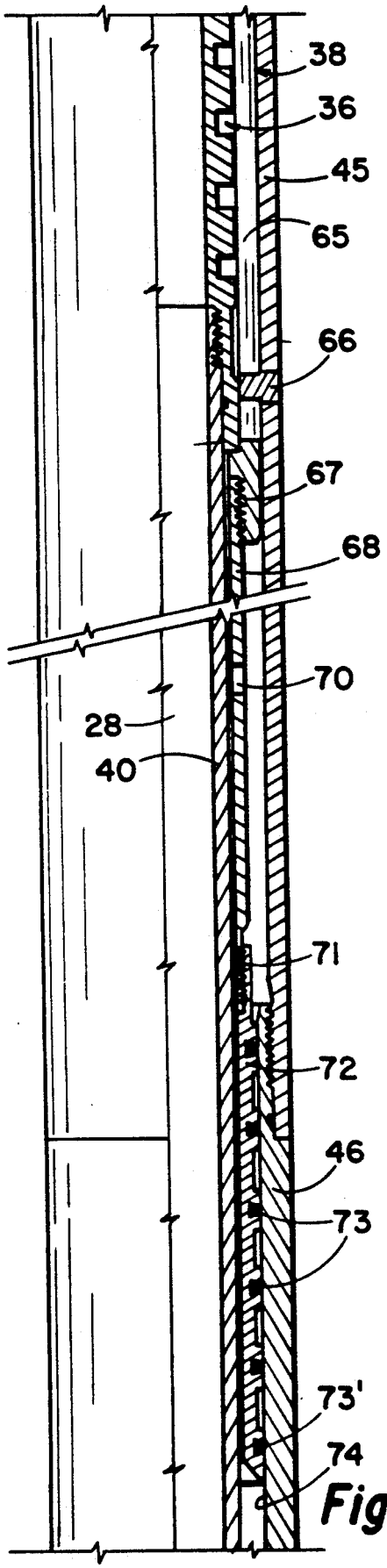

Referring initially to FIG. 1, a well 10 is lined with a casing 11 which has been cemented in place, and which extends down through a producing formation 12. The formation 12 is communicated with the inside of the casing 11 by an interval of perforations 13. When sand entry is a problem an annular region 14 throughout the perforated interval can be packed with gravel to provide a type of screen against the entry of sand particles. In order to place a gravel pack, and to perform other treatments such as circulation and squeezing, a tool string including a packer 15 and a circulating valve apparatus 20, which is constructed in accordance with this invention, is lowered into the well 10 on a work string 16 of tubing. A pipe sub 19 connects the lower end of the packer mandrel 49 to a cross-over sub 9. Another pipe sub 8 can connect the cross-over 9 to a releasable coupling 7 at the upper end of a hook-up nipple 3 which is connected to the top of a screen assembly 6. In some instances the cross-over sub 9 and the releasable coupling 7 can be a combined structure. The coupling 7 can be released hydraulically, mechanically, or a combination of these two modes. The bottom end of the screen assembly 6 is closed by a bull-plug 5. A typical bridge plug 4 is set in the casing 11 below the formation 12 on a wireline setting tool or the like before the gravel pack tool string is run into the well 18. The packer 15 can be any suitable device which has slips and an expander carried near its lower end to anchor against downward movement, elastomeric packing elements to seal off the well bore, and a hydraulic hold-down above the packing element which responds to a greater pressure below the packer to anchor against upward movement. The packer 15 is set, for example by applying torque to release a J-slot control, and then setting down weight to expand the lower normally retracted slips and the packing elements. When set, the packer 15 isolates the zone 17 of the well 10 below the packer from the annulus 18 between the tubing string 16 and the casing 11 above the packer. Various fluids such as acid, water, cement slurry and a carrier fluid with gravel materials suspended therein can be circulated into the well down the tubing 16, out the ports of the cross-over sub 9 and down around the screen assembly 6. The carrier fluid enters the screen assembly 6 and passes upward in the annular space between a flow tube and the packer mandrel 49 to where it enters the annulus 18 above the packer 15 through ports 47 in the wall of the valve apparatus 20. The gravel materials are left behind outside the screen assembly 6 in order to provide sand control as production fluids enter the casing 11 via the perforations 13. When the gravel pack is completed, the coupling 8 is released so that the components of the tool string thereabove can be retrieved to the surface.

Figure 2C:
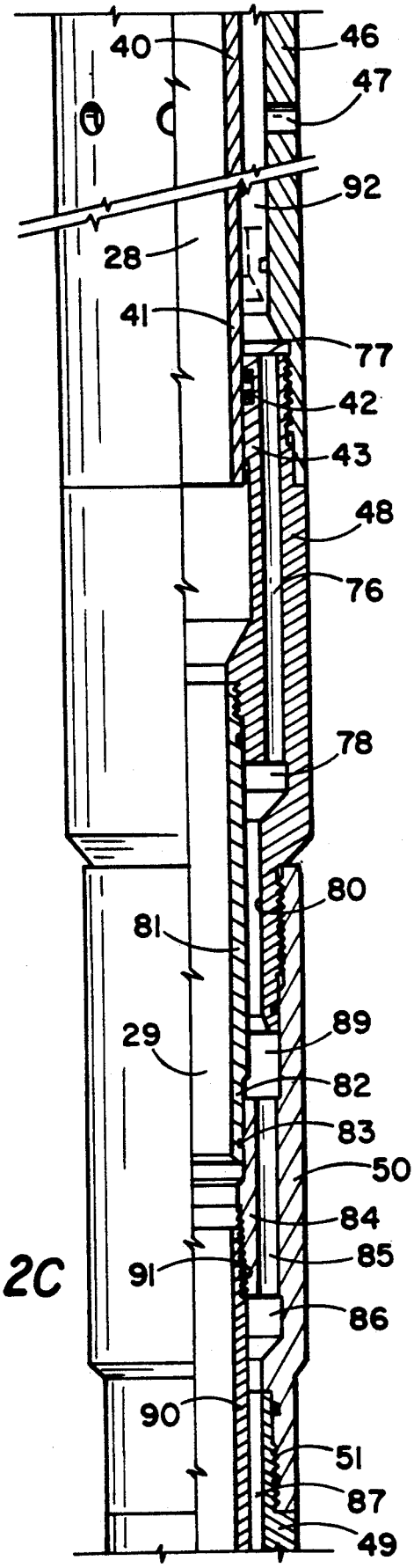

As shown in greater detail in FIGS. 2A–2C, the valve assembly 20 includes an elongated tubular mandrel 30 that is rotatably and telescopically disposed within a tubular housing 31. The mandrel 30 defines a central bore 28 and can be formed in several sections that are threaded end-to-end. The upper section 32 is threaded at 33 to a top sub 34 by which the valve assembly 20 is connected to the lower end of the tubing string 16. A center section 35 of the mandrel 30 is provided with an external helical groove system indicated generally at 36, which cooperates with a pawl 37 that is mounted on the upper end of an actuator sleeve 38. These elements and their operation will be described in further detail below. The lower end of the center section 35 is connected by threads to a lower section 40 which has a lower portion 41 that extends through a seal 42 located on an inwardly directed shoulder section 43 of the housing 31 as shown in FIG. 2C.

The housing 31 also includes a series of threadedly connected sections including an upper end cap 44, an upper section 45 that surrounds the actuator sleeve 38, a mid-section 46 which has a plurality of radial flow ports 47 through the wall thereof as shown in FIG. 2C, an inwardly thickened upper flow passage section 48, and a similar lower flow passage section 50. The housing section 50 has threads 51 at its lower end by which it is connected to the upper end of the mandrel 49 of the packer 15. As shown in FIG. 2A, the upper end portion 52 of the mandrel 30 extends above the upper end of the housing 31, and a guide sleeve 53 which is mounted on such end portion has a lower shoulder 54 that supports the lower end of a coil spring 55. The upper end of the spring 55 engages an outwardly directed flange 56 on the top sub 34 to normally hold the mandrel 30 in its extended position with respect to the housing 31, and to yieldably resist downward relative movement of the mandrel.

To facilitate rotation of the mandrel 30 relative to the housing assembly 31, a bearing 57 can be mounted between the shoulder 54 and the top surface 58 of the housing cap 44. The bearing 57 can include a plurality of balls which are located between upper and lower races. Seal rings 59 prevent fluid leakage between the cap 44 and the mandrel portion 52, and a wiper ring 60 can be used to prevent debris from contacting the seal rings 59. A gauge ring 61 having longitudinal grooves 62 is threaded onto the cap 44 to provide a form of centralizer.

Figure 3:
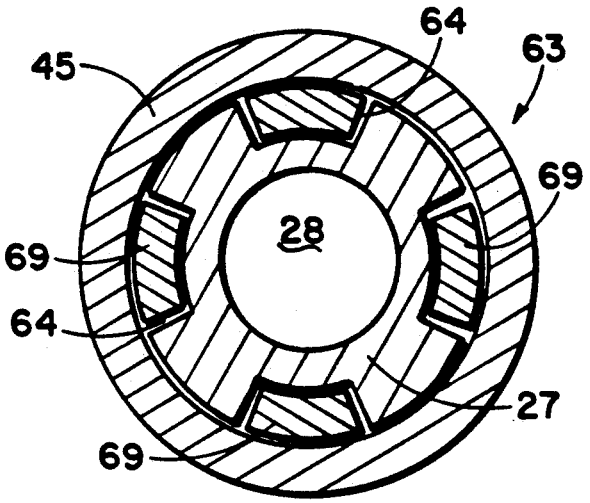
FIG. 3 is a cross-section on line 3—3 of FIG. 2A.

To prevent relative rotation between the mandrel 30 and the housing 31 until a predetermined downward force is applied to the mandrel, a clutch indicated generally at 63 in FIG. 2A is provided. As shown in FIGS. 2A and 3, the clutch 63 includes a plurality of arcuate, longitudinally extending grooves or recesses 64 formed in the enlarged diameter lower end portion 27 of the upper mandrel section 32 which are engaged by downward projecting arcuate lugs 69 on the lower end of the cap 44. So long as the mandrel 30 and the housing 31 are in the relative position shown in FIG. 2A where the lugs 69 engage the grooves 64, torque can be transmitted from the running string 16 and the mandrel 30 to the housing 31 via the clutch 63 in order to un-jay the packer 15. Once the packer 15 is un-jayed, its lower slips and the packing elements are set by imposing a part of the weight of the tubing string 16 on the mandrel 49. As this occurs, the valve mandrel 30 moves downward as the spring 55 partially collapses by a distance sufficient to disengage the grooves 64 from the lugs 69. Typically this distance can be about 2 inches. Then the mandrel 30 can be freely rotated by the tubing 16 relative to the housing 31.

Figure 4:
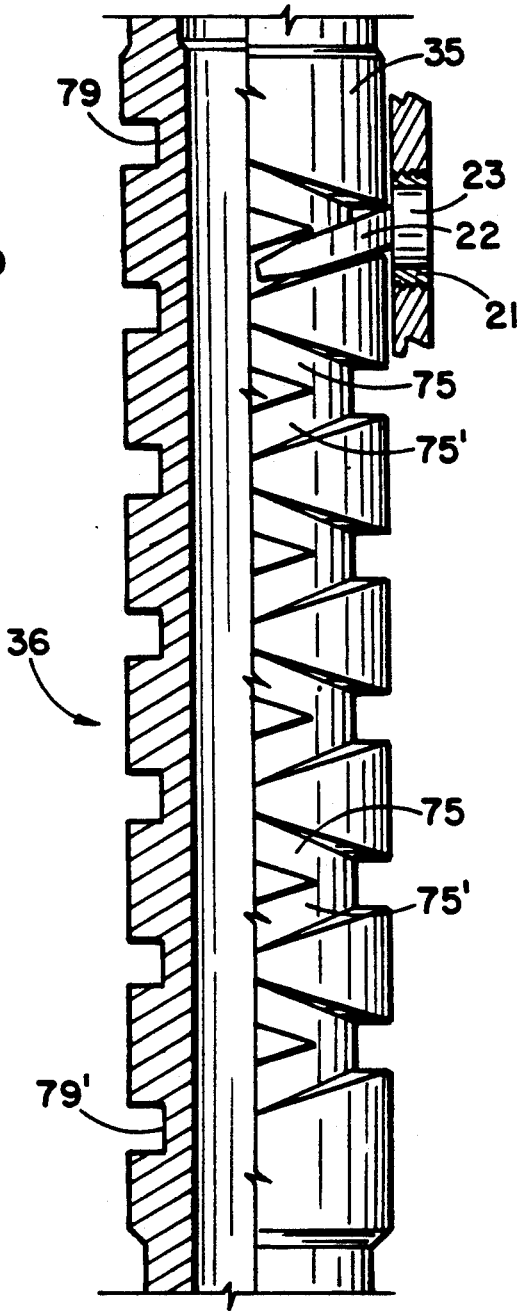
FIG. 4 is a part cross-sectional and a part elevational view of the opposite lead helical groove arrangement on the mandrel.

As shown in FIG. 2B, the actuator sleeve 38 is provided with a pair of diametrically opposed longitudinally extending slots 65 which receive pins 66 that are mounted on opposite sides of the upper section 45 of the housing 31. In actuality, the pins 66 and the slots 65 are located 90° around from the position where they are shown in this figure for convenience of illustration. The engagement of the pins 66 in the slots 65 prevents the actuator sleeve 38 from rotating relative to the housing 31, while permitting longitudinal sleeve movement. When the mandrel 30 is rotated, the actuator sleeve 38 is shifted longitudinally by the engagement of the pawl 37 in the reverse lead helical groove system 36. As shown in FIG. 4, the groove system 36 which is formed in the outer walls of the mandrel section 35 includes a pair of helical grooves 75, 75' which have opposite-hand leads, the groove 75 having a left hand lead and the groove 75' having a right hand lead. The grooves 75, 75' cross one another at various axially spaced locations along the mandrel section 35 as shown, and the adjacent upper and lower end portions of the grooves are connected to one another by respective widened sections 79, 79'.

Figure 5:
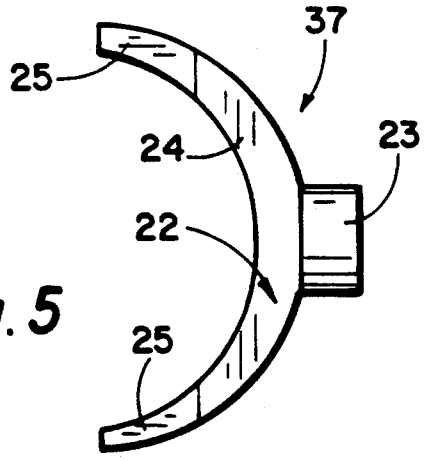
FIG. 5 is a top view of the pawl which engages the groove arrangement shown on FIG. 4.
Figure 6:
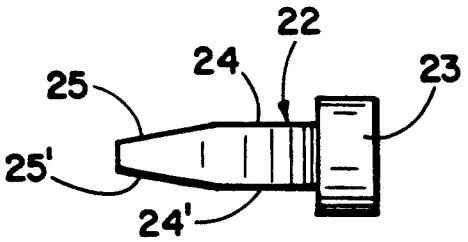
FIG. 6 is a side view of the pawl of FIG. 5.

As illustrated in enlarged detail in FIGS. 5 and 6, the pawl 37 includes a semicircular yoke 22 having a cylindrical head 23 that projects from its outer side. The head 23 is pivotally received in a radial hole in a plug 21 which is threaded into a companion opening in the upper end portion of the actuator sleeve 38. The inner opposite sides 24, 24' of the yoke 22 are parallel as shown, however the outer opposite sides 25, 25' incline toward one another. The yoke 22 rides first in one and then the other of the reverse-lead helical grooves 75, 75', and forces the actuator sleeve 38 to move downward when the yoke transverses the left-hand groove 75 in response to right-hand rotation of the mandrel section 35. As the yoke 22 passes through the lower widened groove 79', it crosses over into the lower end of the right-hand helical groove 75' and causes the actuator sleeve 38 to shift upward during continued right-hand rotation of the mandrel section 35. The same thing happens as the yoke 22 goes through the upper widened groove 79, that is, it enters the upper end of the left-hand groove 75 again and then causes the actuator sleeve 38 to shift downward. Thus the actuator sleeve 38 is reciprocated longitudinally within the housing 31 as the mandrel 30 is rotated clockwise, and can be cycled downward and upward an unlimited number of times in response to rotation of the mandrel 30. In the embodiment shown in FIG. 4, the actuator sleeve 37 is shifted from its upper to its lower position in response to six (6) right-hand revolutions of the mandrel assembly 30. Of course more or less turns can be employed, depending upon the pitch of the grooves 75, 75'.

The lower end of the actuator sleeve 38 is threaded at 67 to a tubular section 68 which can be provided with one or more radial ports 70 through the wall thereof. The ports 70 allow any internal fluid movement that may take place as the clutch 63 is disengaged by downward movement of the mandrel 30, or during longitudinal movement of the actuator sleeve 38. The section 68 is threaded at 71 to the upper end of a valve sleeve 72 which has a series of axially spaced seal rings 73 mounted in grooves on its outer surface. The rings 73 sealingly engage the inner wall surfaces 74 of the housing section 46, and so long as the actuator sleeve 38 is in its upper position, all of the seal rings 73 are located above the circulating ports 47. However as the valve sleeve 72 is advanced downward beyond the point where the lowermost seal ring 73' engages the wall surfaces 74 below the ports 47, the ports are sealed off by at least one pair of the seal rings. In the lower-most position of the valve sleeve 72 as shown in phantom lines in FIG. 2C, which includes the two inches of travel due to disengagement of the clutch mechanism 63, three of the seal rings 73 are located below the ports 47, and three above it. Each of the seals 73 engages the wall surface 74 on the same diameter so that the valve sleeve 72 is pressure balanced in the closed position.

The housing section 48 has formed therein a plurality of longitudinal flow passages 76 which lead from its top surface 77 down to an internal annular recess 78 which communicates with the bore 80 through the lower portion of the section. A tube 81 having its upper end sealed and threaded to the housing section 48 extends downward to where its lower end 82 is sealed by rings 83 against an inner wall of the part 84 of the lower housing section 50. Hereagain, flow passages 85 whose upper ends communicate with the internal annular recess 89 below the bore 80 are formed in the housing section 50 and lead to an internal annular cavity 86 which communicates with the annular space 87 between the outer wall of an inner mandrel 90 and the inner wall of the packer mandrel 49. The upper end of the inner mandrel 90 is threaded at 91 to the housing section 50, and although not shown in detail in the drawings, this mandrel extends down through the bore of the packer mandrel 49 and beyond the lower end thereof to a point just above the flow ports of the cross-over sub 9 in order to carry fluid flow to the sub where it can exit via the cross-over ports into the zone 17 below the packer 15, or from such zone up into the annulus 18.

OPERATION

In operation, the parts of the circulating valve assembly 20 are assembled as shown in the drawings and connected to the top of the packer 15 by threading the lower housing section 50 to the upper end of the packer mandrel 49. The pipe member 19, the cross-over sub 9, the pipe member 8, the releasable coupling 7, the hook-up nipple 3 and the screen assembly 6 are connected end-to-end to the lower end to the packer mandrel 49, and the inner mandrel 90 extends through the packer mandrel 49 and on down to just above the ports in the cross-over sub 9 as shown in doted lines in FIG. 1. The top sub 34 of the mandrel 30 then is threaded to the lower end of a joint or a stand of the tubing 16, and the assembled tool string is run into the well bore as additional joints or stands of the tubing thereabove are connected end-to-end. Of course the bridge plug 4 will have been previously set in the casing at a location below the lowermost ones of the perforations 13. During running, the housing ports 47 can be open as shown in FIG. 2C so that fluids in the well bore can bypass through the packer 15 and into the annulus 18 via the flow passages 87, 86, 85, 89, 80, 78 and 76, the annular space 92 in the lower part of the housing section 46, and the circulating ports 47. When the screen assembly 6 reaches the proper depth and location in the casing 11 opposite the perforations 13, the tool string is halted. At this point the clutch mechanism 63 still is engaged so that torque from the tubing 16 can be transmitted through the valve 20 and employed to un-jay the packer 15. Then a portion of the weight of the tubing string 16 can be slacked off on the packer 15 to set it. At this point the flow ports 47 can still be open so that the zone 17 below the packer 15 is in communication with the annulus 18 thereabove. The imposition of weight on the packer 15 also compresses the spring 55 and shifts the spline recesses 64 out of engagement with the lugs 69. With the flow ports 47 open, a circulation path for fluids pumped down the tubing 16, is provided through the bore 28 of the tool 20 and the bore of the inner mandrel 90, out the ports of the cross-over sub 9, through the annular space 14 around the screen 6, back up through longitudinal ports in the cross-over sub 9, through the flow passage 87, 85, 80 and 76 and the flow ports 47 out into the annulus 18 above the packer 15 where they can return to the surface. If it is desired to squeeze a fluid into the formation 12, the circulating valve 20 can be closed as follows. Since the clutch 63 has been disengaged, the valve sleeve 72 can be actuated by rotating the mandrel 30 relative to the housing 31 and the actuator sleeve 38, which is held against rotation by engagement of the pins 66 in the slots 65. The left hand helical groove 75 on the mandrel 30 causes the pawl 37 and the actuator sleeve 38 to be shifted downward. As noted above, 6 complete turns will advance the valve sleeve 72 to its lowermost position where the seal rings 73 are symmetrically disposed below and above the ports 47 in order to close them off. To re-open the valve 20, another 6 turns of the mandrel 30 to the right will cause the right-hand groove 75', and the pawl 37 and the actuator sleeve 38 to shift the valve sleeve 72 back up to its uppermost position. In such upper position the flow ports 47 are open as shown in FIG. 2C. Such opening and closing can be carried out an unlimited number of times.

With the ports 47 open, various fluids and materials can be circulated down through the tubing 16 and into the zone 17 below the packer 15 via the cross-over sub 9. When the ports 47 are closed, pressure can be applied to the tubing 16 at the surface, for example to squeeze fluids such as acid, water or cement through the perforations 13 and into regions behind the casing 11. Thus operations such as hydraulic fracturing and acidizing can be performed. When the ports 47 are open, the well can be circulated, and a carrier fluid and gravel particles can be pumped down the tubing 16 to form a gravel pack in the region 14 around the screen assembly 6.

If the operator looses track of where in the cycle of operations the tool 20 may be, pressure can be applied to the annulus 18 while slowly rotating to the right, and it will be immediately apparent from a pressure surge at the surface when the lower seal ring 73' is positioned just below the flow ports 47. A few more turns will shift the valve sleeve 72 to its fully-down position where the various pairs of seal rings 73 are located symmetrically above and below the flow ports 47. Where desirable, the tool string can be run into the well 10 with the flow ports 47 closed by compressing the spring 55 and then rotating the mandrel 30 six turns relative to the housing 31 at the surface. The tool string also can be retrieved from the well with the ports 47 closed by leaving the valve sleeve 72 in the lower position, and then picking the tubing 16 straight up to unset the packer 15. Thus the circulating valve 20 is very versatile in operation, and can be used to accomplish a number of well treating, squeezing, acidizing and gravel packing procedures.

It now will be recognized that a new and improved circulating valve apparatus has been disclosed which meets all the objectives of the present invention, and has each of the various advantages and features mentioned above. Although the invention has been disclosed primarily in connection with sand control operations, it can have numerous other applications as mentioned herein, as well as others as will be apparent to those skilled in this art. Since certain changes or modifications may be made in the disclosed embodiment without departing from the inventive concepts involved, it is the aim of the appended claims to cover all such changes and modifications falling within the true spirit and scope of the present invention.

What is claimed is:

1. Valve apparatus for use in a well, comprising: a housing; a mandrel mounted for rotation in said housing and for limited telescopic movement, and mandrel being adapted to be connected to a running string of pipe which extends upward to the surface and said housing being adapted to be connected to a packer; clutch means on said mandrel and housing for preventing relative rotation until a selected amount of the weight of the running string is imposed on said mandrel to move it downward a predetermined distance relative to said housing; port means in said housing; sleeve valve means for closing and opening said port means; and actuator means responsive to only right-hand rotation of said mandrel for shifting said sleeve valve means to effect closing and opening of said port means.

2. The apparatus of claim 1 wherein said clutch means includes co-engaging lug and recess means on said mandrel and housing.

3. The apparatus of claim 2 further including spring means reacting between said mandrel and said housing for normally holding said clutch means engaged, said weight deflecting said spring means by said predetermined distance.

4. The apparatus of claim 1 when said actuator means includes reverse lead helical groove means on said mandrel; an actuator sleeve between said mandrel and housing and coupled to said sleeve valve means; and pawl means on said actuator sleeve cooperable with said groove means for shifting said actuator sleeve and sleeve valve means between longitudinally spaced positions in response to rotation of said groove means in the right hand direction relative to said actuator sleeve and housing.

5. The apparatus of claim 4 wherein said pawl means includes generally semicircular yoke means that slides in said groove means, and means for pivotally attaching said yoke means to said actuating sleeve.

6. The apparatus of claim 5 wherein the adjacent upper and lower end portions of said helical groove means are axially widened to allow said yoke means to pass from one of said reverse lead groove means to the other and thereby reverse the direction of longitudinal movement of said actuator sleeve.

7. The apparatus of claim 6 further including means for preventing rotation of said actuator sleeve relative to said housing during longitudinal shifting of said actuator sleeve.

8. The apparatus of claim 7 wherein said preventing means includes pin means fixed to said housing and extending inwardly into longitudinal slot means in said actuator sleeve.

9. The apparatus of claim 1 wherein said sleeve valve means includes a sleeve member having seal means carried on external surfaces thereof and engaging inner wall surfaces of said housing adjacent said port means, said seal means being arranged to engage above and below said port means in the closed position of said sleeve member.

10. The apparatus of claim 9 wherein said seal means are arranged in symmetrically mounted pairs so that a plurality of said seal means engage said inner wall surfaces above and below said port means in said closed position.

11. The apparatus of claim 9 wherein said seal means each have the same diameter of sealing engagement whereby said sleeve member is balanced with respect to fluid pressures in said closed position.

12. A method of selectively opening and closing a circulation flow path between the well annulus above a packer and a zone in the well below said packer, comprising the steps of: providing a circulating valve that includes a mandrel which is rotatable within a housing, said mandrel being connected to a running string that extends upward to the surface and said housing being connected to said packer; releasably connecting said mandrel against rotation relative to said housing so that torsional forces can be transmitted therethrough to set said packer; imposing a portion of the weight of the running string on said mandrel to release said connection and thereby enable rotation of said mandrel; rotating said mandrel in only the right-hand direction relative to said housing; and in response to said rotation, actuating said circulation valve thereby repeatedly closing and opening said circulation flow path.

13. The method of claim 12 wherein the upper end of said circulation flow path is provided by ports through the wall of said housing, and including the further step of providing a sleeve valve that shifts downward in response to said right-hand rotation to close said ports and upward in response to continued right-hand rotation to open said flow ports, said ports being closed and opened an unlimited number of times so long as said rotation is performed while said weight is imposed on said mandrel.

* * * * *